US006659670B1

(12) United States Patent
Blousé

(10) Patent No.: US 6,659,670 B1
(45) Date of Patent: Dec. 9, 2003

(54) MOP WITH SPRAYER

(75) Inventor: Gary Blousé, Oakland, CA (US)

(73) Assignee: AMS Industries, Inc., San Leandro, CA (US)

( * ) Notice: Subject to any disclaimer, the term of this patent is extended or adjusted under 35 U.S.C. 154(b) by 0 days.

(21) Appl. No.: 10/068,498

(22) Filed: Feb. 5, 2002

Related U.S. Application Data

(60) Provisional application No. 60/347,464, filed on Jan. 14, 2002.

(51) Int. Cl.[7] ..... A47L 1/08; A47L 13/22; A47L 13/26; A47L 13/30; B43M 11/02

(52) U.S. Cl. ..... 401/137; 401/139; 401/279; 15/228

(58) Field of Search ..... 401/136–140, 401/126, 130, 268, 275, 279; 15/50.1, 228, 231

(56) References Cited

U.S. PATENT DOCUMENTS 3,123,851 A * 3/1964 Arndt et al. ..... 401/138
3,134,129 A * 5/1964 Allen ..... 401/138
3,254,804 A * 6/1966 Grant ..... 401/137
4,432,472 A * 2/1984 Lamm ..... 401/138
4,852,210 A * 8/1989 Krajicek ..... 15/231
5,553,344 A * 9/1996 Rosenkrantz ..... 15/231
5,888,006 A * 3/1999 Ping et al. ..... 401/139
5,915,437 A * 6/1999 Petner ..... 15/228
6,098,239 A * 8/2000 Vosbikian ..... 15/228

* cited by examiner

*Primary Examiner*—Tuan N. Nguyen
(74) *Attorney, Agent, or Firm*—Jack Lo

(57) ABSTRACT

A mop is comprised of a handle, a stem extending from the handle, and a mop head connected to the lower end of the stem by a hinged joint. The stem is comprised of plural collapsible sections. A trigger is hinged to the handle. A spray bottle is positioned in the mop head. A cable is connected between the trigger and a spray mechanism on the spray bottle, and is positioned through the stem and hinged joint. A spring is connected between the trigger and the inner end of the handle to enable the cable to be pulled away slightly from the handle for collapsing the stem. A nozzle on the spray bottle is positioned towards one side of the mop head, and angled to spray the fluid at an acute angle across the front of the mop head. A replaceable pad is detachably secured to the mop head.

13 Claims, 4 Drawing Sheets

MOP WITH SPRAYER

ACROSS REFERENCE TO RELATED APPLICATION

We claim the benefit of provisional application No. 60/347,464 filed on Jan. 14, 2002.

BACKGROUND OF THE INVENTION

1. Field of the Invention

This invention relates generally to mops.

2. Prior Art

Some mops are provided with a built-in sprayer for applying a cleaning fluid to the floor in front of the mop head. The container for the fluid is usually attached to a stem between the handle and the mop head. A pump is attached to the bottle to deliver the cleaning fluid through a long tube to a nozzle at the center of the mop head. However, attaching the fluid container to the stem makes the handle too heavy to hold. Also, when the pump becomes worn out, the mop is rendered useless. Further, the one-piece stem is more difficult to ship, display, and store.

BRIEF SUMMARY OF THE INVENTION

The objects of the present mop are:

- to provide a mop head with a replaceable cleaning pad for mopping a floor;
- to provide a spray bottle for applying a cleaning fluid in front of the mop head;
- to position the spray bottle in the mop head for reducing the weight of the handle, and for helping press the mop head onto the floor;
- to enable easy replacement of the spray bottle; and
- to provide a collapsible stem between the handle and the mop head.

The present mop is comprised of a handle, a stem extending from the handle, and a mop head connected to the lower end of the stem by a hinged joint. The stem is comprised of plural collapsible sections or a single non-collapsible section. A trigger is hinged to the handle. A spray bottle is positioned in the mop head. A cable is connected between the trigger and a spray mechanism on the spray bottle, and is positioned through the stem and hinged joint. A spring is connected between the trigger and the inner end of the handle to enable the cable to be pulled away slightly from the handle for collapsing the stem. A nozzle on the spray bottle is positioned towards one side of the mop head, and angled to spray the fluid at an acute angle across the front of the mop head. A replaceable cleaning cloth or pad is detachably secured to the mop head.

Figures 1, 2:
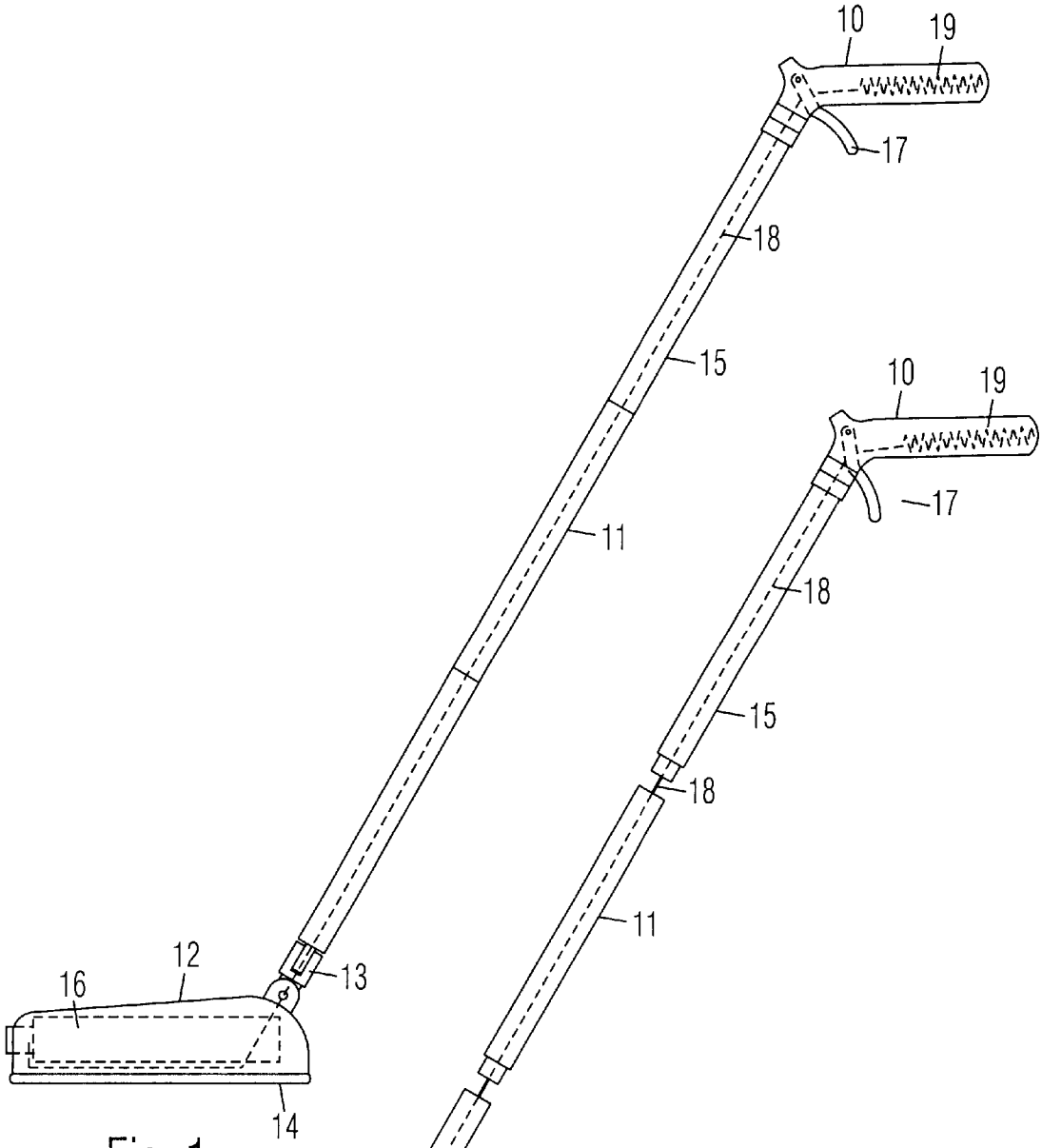
FIG. 1 is a side view of the present mop.
FIG. 2 is a side view thereof with the sections of its stem disconnected.

| DRAWING REFERENCE NUMERALS | |
|---|---|
| 10. Handle | 11. Hollow Stem |
| 12. Mop Head | 13. Hinged Joint |
| 14. Cleaning Pad | 15. Tubes |
| 16. Spray Bottle | 17. Trigger |
| 18. Cable | 19. Tensioning Device |
| 20. Spray Mechanism | 21. Fluid Container |
| 22. Cleaning Fluid | 23. Pulley |
| 24. Hinged Arm | 25. Lever |
| 26. Hook-and-Loop Fastener | 27. Hook-and-Loop Fastener |
| 28. Hole | 29. Pin |
| 30. Star Shaped Lattice | 31. Barb |
| 32. Cleaning Pad | 33. First Tongue-and-Groove Means |
| 34. Second Tongue-and-Groove Means | 35. Plate |
| 36. Cleaning Pad | 37. Straps |

DETAILED DESCRIPTION OF THE INVENTION

FIGS. 1–2

A preferred embodiment of the present mop is shown in a side view in FIG. 1. It is comprised of a long handle 10 which includes a hollow stem 11, and a mop head 12 connected to the lower end of handle 10 by a hinged joint 13. A replaceable cleaning pad 14 is detachably secured to a bottom of mop head 12.

Stem 11 is preferably comprised of plural collapsible tubes 15 for easier shipping and storage. Hinged joint 13 is preferably comprised of a universal joint for enabling mop head 14 to stay in full contact with the floor regardless of the angle of stem 11. A spray bottle 16 is positioned inside mop head 14 for spraying a cleaning fluid onto the floor in front of mop head 12. Positioning spray bottle 16 in mop head 12 lightens handle 11 for reducing user fatigue, but weights down mop head 12 to press it more firmly on the floor for better cleaning.

An inner end of a trigger 17 is hinged inside handle 10 near its upper end. A cable 18 is positioned within handle 10 and mop head 12. Cable 18 is connected between an intermediate portion of trigger 17 and spray bottle 16, and is positioned through hinged joint 13. Since cable 18 is entirely enclosed by stem 11, hinged joint 13, and mop head 12, it is protected from damage and entanglement. Cable 18 also enables the remote positioning of spray bottle 16 away from trigger 17 and inside mop head 12. Alternatively, cable 18 may be positioned outside handle 10.

A tensioning device 19, such as a spring, is connected between an intermediate portion of trigger 17 and an interior of handle 10. Tensioning device 19 enables cable 18 to be pulled slightly away from handle 10 to allow tubes 15 of stem 11 to be pulled apart for compacting, as shown in FIG. 2. Alternatively, stem 11 may be comprised of a single tube which is not collapsible, and tensioning device 19 may be eliminated.

FIG. 3

Figure 3:
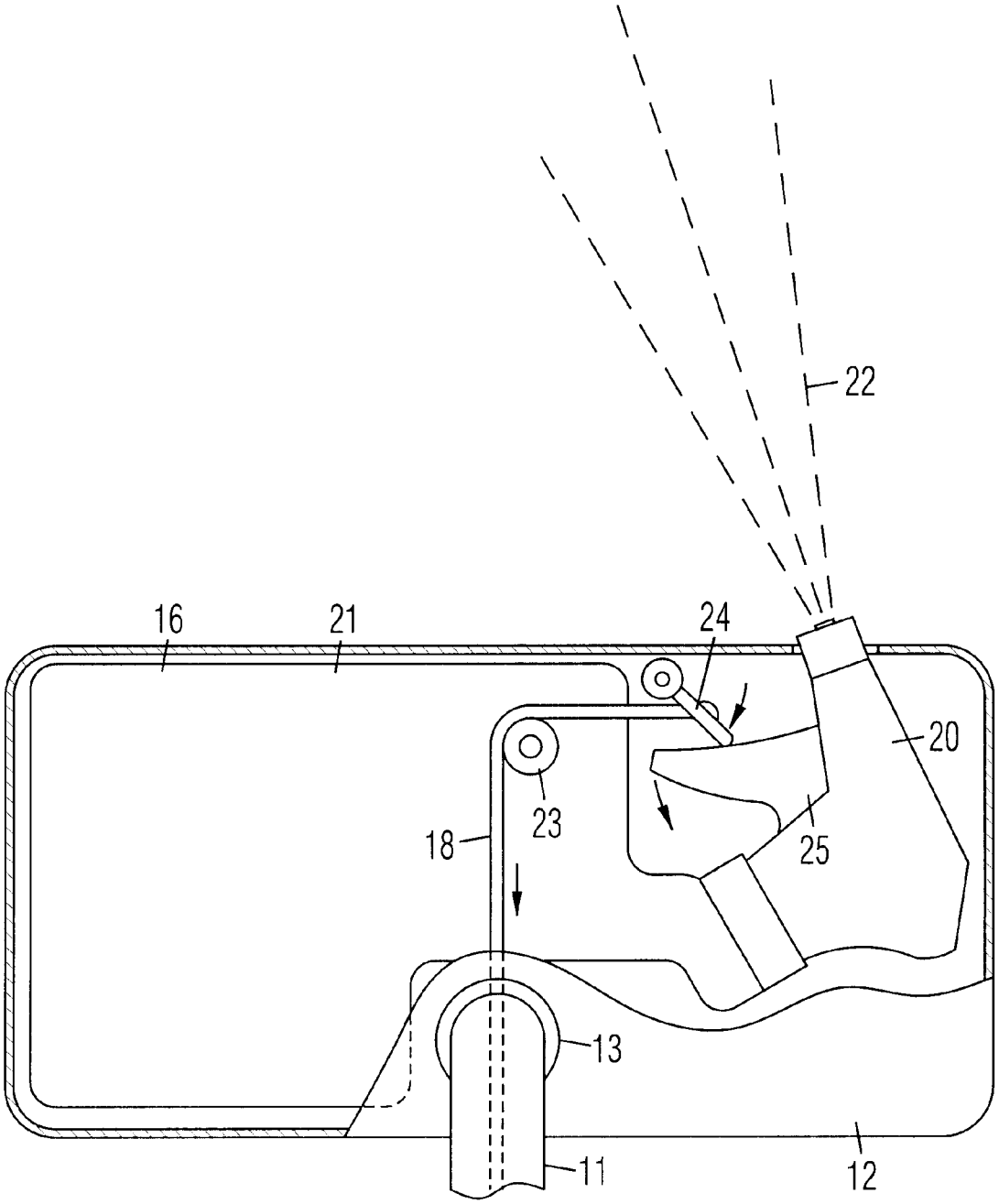
FIG. 3 is a top cutaway view of the mop head.

A top cutaway view of mop head 12 is shown in FIG. 3. Spray bottle 16 is positioned horizontally within mop head 12, and is comprised of a spray mechanism 20 directly attached to an end of a fluid container 21. Spray bottle 16 is similar to a conventional spray bottle for simplicity and low cost. Spray bottle 16 also conforms to conventional packaging specifications for easier distribution with existing retail structures. Alternatively, spray bottle 16 may have be a specially shaped bottle with a centrally located nozzle to avoid having to angle the spray direction. Also, the spray mechanism may be separate from the container and connected thereto by a tube, although the spray mechanism and the container are still both inside the mop head.

Since spray mechanism 20 is positioned towards one side of mop head 12, it must be angled to spray cleaning fluid 22 at an acute angle across the front of mop head 12. In the embodiment shown, spray mechanism 20 is angled relative to container 21. Alternatively, spray mechanism 20 may be perpendicular to container 21, but the entire spray bottle 16 may be angled relative to mop head 12.

The entire spray bottle 16 is replaceable by the user when the cleaning fluid is depleted, or when spray mechanism 20 is worn out. Spray bottle 16 may be accessed by removing a top or bottom cover of mop head 12, or it may sit exposed in a cradle on top of mop head 12.

The lower end of cable 18 extending through joint 13 is attached to spray mechanism 20. In the exemplar arrangement shown, cable 18 is partially wrapped around a pulley 23 attached to mop head 12 to turn about 90 degrees towards spray mechanism 20. The distal end of cable 18 is connected to a hinged arm 24 positioned against a lever 25 on spray mechanism 20. When the trigger on the handle is pulled, cable 18 is pulled towards the handle, and the free end of hinged arm 24 is rotated to move lever 25 and activate spraying. Alternatively, cable 18 may be routed through mop head 12 differently, and it may also be directly attached to lever 25.

FIGS. 4–7

Figure 4:
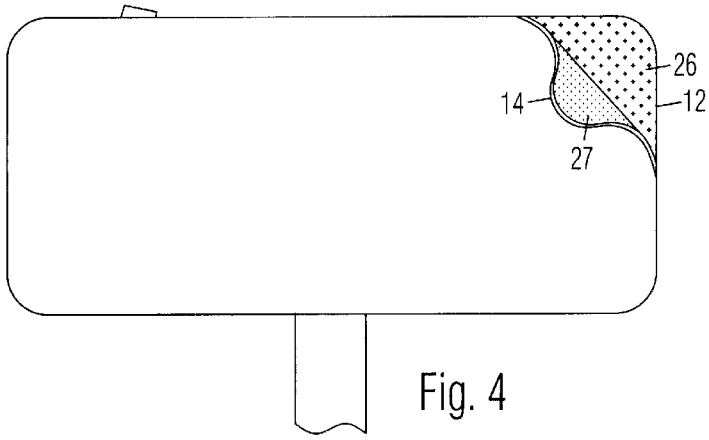
FIG. 4 is a bottom view of the mop head showing a first embodiment of a replaceable pad.
Figure 5:
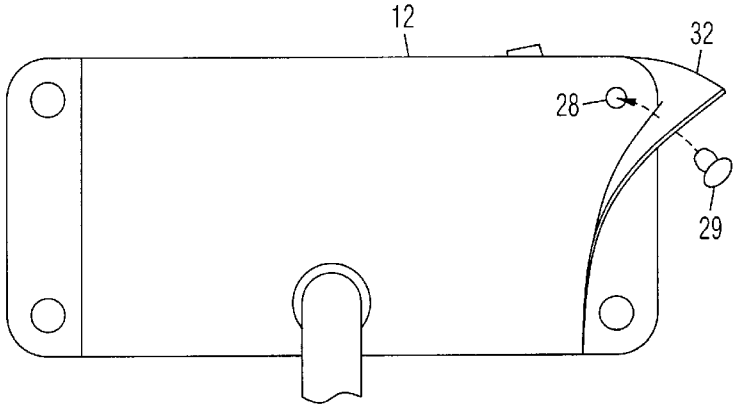
FIG. 5 is a top view of the mop head showing a second embodiment of the replaceable pad.
Figure 6:
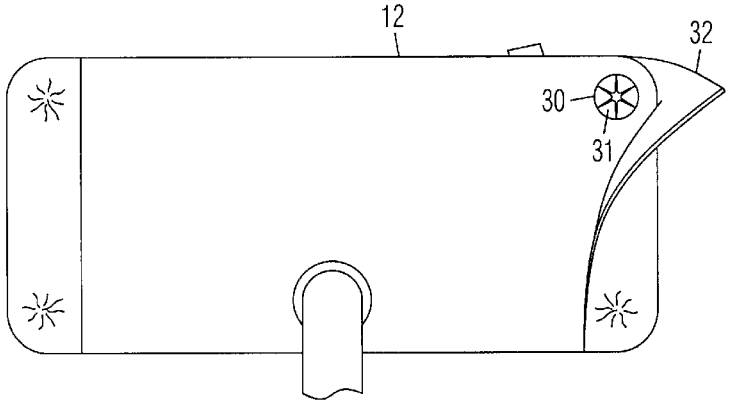
FIG. 6 is a top view of the mop head showing a third embodiment of the replaceable pad.

Pad 14 may be attached to the bottom of mop head 12 in the exemplar ways shown in FIGS. 4–6. In a first embodiment shown in the bottom view in FIG. 4, pad 14 is attached by hook-and-loop fasteners 26 and 27.

In a second embodiment shown in the top view in FIG. 5, a pad 32 is positioned under mop head 12 and the sides wrapped around mop head 12. The sides of pad 32 are attached by pushing material at its corners into holes 28 on top of mop head 12 with pins 29, which are sized to fit snugly inside holes 28 when pad material is jammed between pins 29 and respective holes 28.

In a third embodiment shown in the top view in FIG. 6, pad 32 is attached by pushing its corners into star shaped lattices 30 with one-way barbs 31 that retain the pad material inside lattices 30.

Figure 7:
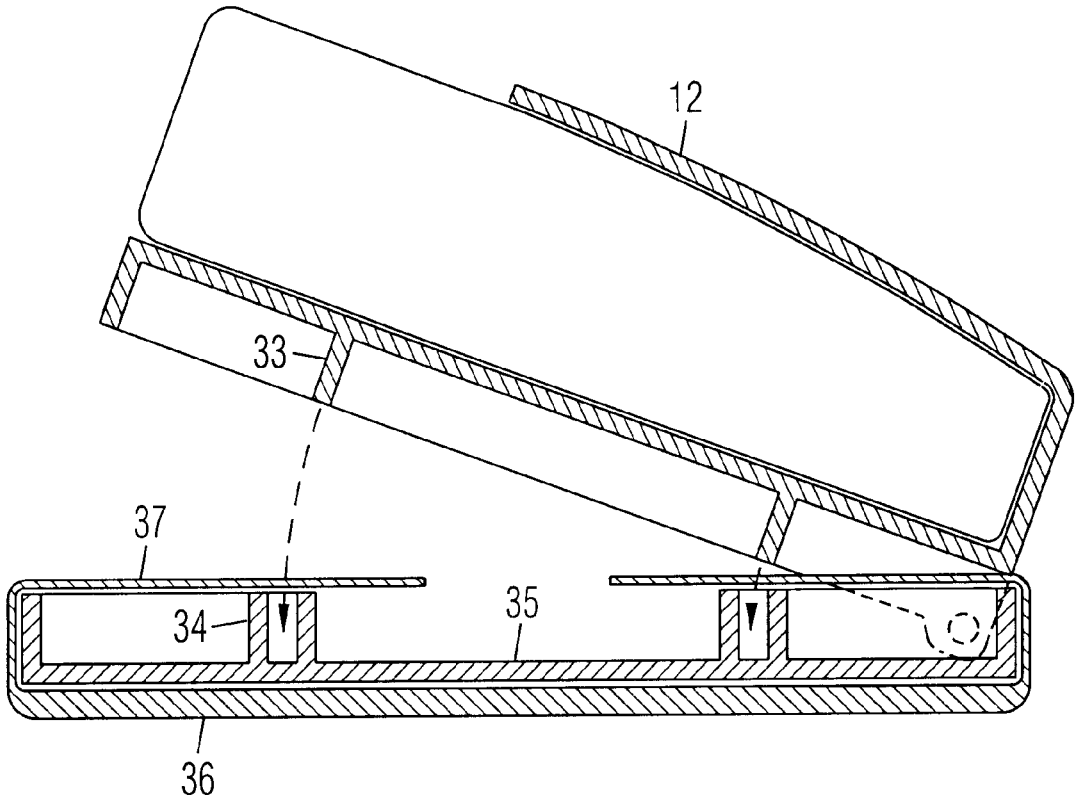
FIG. 7 is a side sectional view of a fourth embodiment of the replaceable pad.

In the fourth embodiment shown in the side sectional view in FIG. 7, first tongue-and-groove means 33 on the bottom of mop head 12 are arranged to mate with second tongue-and-groove means 34 on top of a plate 35 under mop head 12. Plate 35 is preferably hinged to mop head 12. First tongue-and-groove means 33 may be comprised of tongues and second tongue-and-groove means 34 may be comprised of grooves, or vice versa. A cleaning pad 36 are provided with straps 37 that wrap around the top of plate 35. When plate 35 is mated to the bottom of mop head 12, straps 37 are jammed between first tongue-and-groove means 33 and second tongue-and-groove means 34 to secure cleaning pad 36 in position.

Accordingly, the present mop provides a mop head for cleaning a floor. It provides a spray bottle for applying a cleaning fluid in front of the mop. It positions the spray bottle in the mop head for reducing the weight of the handle, and for helping press the mop head onto the floor for more effective cleaning. It enables easy replacement of the spray bottle when the fluid is depleted or when the spray mechanism is worn out. It provides a collapsible stem between the handle and the mop head. It also provides a replaceable cleaning pad on the mop head.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A mop, comprising:

a handle;

a trigger attached adjacent a top end of said handle;

a mop head connected to a lower end of said handle;

a spray bottle positioned inside said mop head for spraying a cleaning fluid onto a floor in front of said mop head, wherein said spray bottle is arranged in said mop head to reduce weight on said handle and to press said mop head more firmly on the floor for better cleaning, said spray bottle is comprised of a spray mechanism connected to a cleaning fluid container;

a cable connected between said trigger and said spray bottle; and a hinged joint connected between said lower end of said handle and said mop head, wherein said cable is positioned through said handle and said hinged joint for protection from damage.

2. A mop, comprising:

a handle;

a trigger attached adjacent a top end of said handle;

a mop head connected to a lower end of said handle;

a spray bottle positioned inside said mop head for spraying a cleaning fluid onto a floor in front of said mop head, wherein said spray bottle is arranged in said mop head to reduce weight on said handle and to press said mop head more firmly on the floor for better cleaning, said spray bottle is comprised of a spray mechanism connected to a cleaning fluid container;

a cable connected between said trigger and said spray bottle;

first tongue-and-groove means on a bottom of said mop head;

a plate under said mop head;

second tongue-and-groove means on a top of said plate detachably mated to said first tongue-and-groove means; and a replaceable pad positioned under said plate, and includes straps wrapped around said top of said plate, wherein said straps are jammed between said first tongue-and-groove means and said second tongue-and-groove means.

3. A mop, comprising:

a handle including a collapsible stem comprised of a plurality of detachable tubes;

a trigger attached adjacent a top end of said handle;

a mop head connected to a lower end of said handle by a hinged joint;

a spray bottle positioned inside said mop head for spraying a cleaning fluid onto a floor in front of said mop head, wherein said spray bottle is arranged in said mop head to reduce weight on said handle and to press said mop head more firmly on the floor for better cleaning, said spray bottle is comprised of a spray mechanism connected to a cleaning fluid container;

a cable positioned through said stem, said hinged joint, and said mop head, and connected between said trigger and said spray mechanism of said spray bottle; and a tensioning device connected between said trigger and an interior of said handle to apply tension to said cable and enable said cable to be pulled away from said handle to allow said tubes of said stem to be pulled apart for compacting.

4. The mop of claim 3, wherein said spray mechanism is directly attached to an end of said container and positioned towards a side of said mop head, said spray mechanism is angled relative to said mop head for angling a spray of said cleaning fluid across a front of said mop head.

5. The mop of claim 3, wherein said spray bottle is removable from said mop head for replacement.

6. The mop of claim 3, further including a replaceable pad attached by hook-and-loop fasteners to a bottom of said mop head.

7. The mop of claim 8, further including:

first tongue-and-groove means on a bottom of said mop head;

a plate under said mop head;

second tongue-and-groove means on a top of said plate detachably mated to said first tongue-and-groove means; and a replaceable pad positioned under said plate, and includes straps wrapped around said top of said plate, wherein said straps are jammed between said first tongue-and-groove means and said second tongue-and-groove means.

8. A mop, comprising:

a handle;

a trigger attached adjacent a top end of said handle;

a mop head attached to a lower end of said handle;

a spray bottle positioned inside said mop head for spraying a cleaning fluid onto a floor in front of said mop head, wherein said spray bottle is arranged in said mop head to reduce weight on said handle and to press said mop head more firmly on the floor for better cleaning, said spray bottle is comprised of a spray mechanism directly attached to an end of said container and offset towards a side of said mop head, said spray mechanism is angled relative to said mop head for angling a spray of said cleaning fluid across a front of said mop head; and a cable connected between said trigger and said spray mechanism of said spray bottle.

9. The mop of claim 8, wherein said spray bottle is removable from said mop head for replacement.

10. The mop of claim 8, wherein said cable is positioned inside said handle for protection from damage.

11. The mop of claim 8, further including a hinged joint connected between said lower end of said handle and said mop head, wherein said cable is positioned through said handle and said hinged joint for protection from damage.

12. The mop of claim 8, further including a replaceable pad attached by hook-and-loop fasteners to a bottom of said mop head.

13. The mop of claim 8, further including:

first tongue-and-groove means on a bottom of said mop head;

a plate under said mop head;

second tongue-and-groove means on a top of said plate detachably mated to said first tongue-and-groove means; and a replaceable pad positioned under said plate, and includes straps wrapped around said top of said plate, wherein said straps are jammed between said first tongue-and-groove means and said second tongue-and-groove means.

* * * * *